United States Patent [19]

Snider, Jr.

[11] 4,349,989

[45] Sep. 21, 1982

[54] FENCE GUARD

[76] Inventor: H. Dean Snider, Jr., 9466 Pitch Pine Dr., Shreveport, La. 71118

[21] Appl. No.: 246,602

[22] Filed: Mar. 23, 1981

[51] Int. Cl.[3] ..... E04H 17/06

[52] U.S. Cl. ..... 47/33; 256/32

[58] Field of Search ..... 47/32–33; 256/1, 19, 32–58

[56] References Cited

U.S. PATENT DOCUMENTS

| | | | |
|---|---|---|---|
| 3,545,127 | 12/1970 | Jensen | 47/33 |
| 3,713,624 | 1/1973 | Niemann | 47/33 X |
| 3,806,096 | 4/1974 | Eccleston et al. | 47/33 X |

*Primary Examiner*—Robert E. Bagwill

*Attorney, Agent, or Firm*—John M. Harrison

[57] ABSTRACT

A fence guard for installation along a fence line for the purpose of preventing or retarding the growth of grass, weeds and other vegetation under and along a fence, which fence guard includes an elongated grass shield fitted along the straight runs of the fence line adjacent to the fence posts and extending outwardly from one or both sides of the fence line to cover the ground and grass along the fence. A swivel joint for attachment to the base of fence posts in the fence line at points where the fence changes direction; specially configured gate plates for mounting to the base of the gate posts installed in the fence and corner post plates provided at the base of each fence post in the fence line at points where a 90 degree directional turn is achieved, or where several fence lines meet, to match cooperating lengths of the grass shield.

10 Claims, 7 Drawing Figures

FENCE GUARD

BACKGROUND OF THE INVENTION

1. Field of the Invention

This invention relates to the elimination of grass, weeds and other vegetation from fence lines, and more particularly, to a grass shield device for installation along fences, and chain link fences in particular, to prevent or retard the growth of grass, weeds and other vegetation along and beneath the fence. The fence guard of this invention is characterized by an elongated grass shield which, in a preferred embodiment, is manufactured in selected lengths and widths, and is designed to be installed beneath chain link fences in cooperation with the fence posts to prevent the growth of grass and weeds in an area extending beside and beneath the fence posts, from three to about eight inches transverse to and on either side of the fence line. During installation, the grass shield is provided with transverse slits and holes in spaced relationship adjacent the slits to accommodate the fence posts. In a preferred embodiment, the grass shield is fitted with a longitudinal slot in the middle thereof to receive the bottom of the fence. Cooperating swivel joints and corner post plates are provided to maintain the continuity of the grass shield at points where the fence line makes directional changes, and where several fence lines meet, and specially designed gate plates are provided for installation of opposing gate posts where it is desired to hang a swinging gate. While the fence guard of this invention is specifically designed for application to existing chain link fences, it will be appreciated by those skilled in the art that the guard can be applied to virtually any fence by simply shaping the periodic post holes in the grass shield, and the holes in the swivel joints, corner post plates and gate plates, to accommodate the specific post under consideration, according to the teachings of this invention.

2. Description of the Prior Art

Grass guards, barriers and shields for preventing the growth of grass, weeds, woody growth and other vegetation along fence lines have generally taken the form of shaped, stripping or edging members which can be laid along or built into a fence during construction of the fence to eliminate the objectionable growth. For example, U.S. Pat. No. 3,384,351 to A. W. Turner, Jr., discloses a grass guard in cooperation with a fence, which includes such a barrier, provided in rolls, and including multiple cover plates designed to seal the ends of the stripping, and particularly the area near the posts. The grass guard is primarily designed for use and application to the ground along a fence line while erecting the fence and prior to application of the fence paneling or chain link to the posts. Another grass and weed barrier is disclosed in U.S. Pat. No. 3,393,897 to L. E. Wright, which patent discloses a metallic barrier for use in combination with a fence to prevent the growth of vegetation along the fence line, which barrier includes a horizontal wall disposed adjacent to the fence, and having vertical outer walls embedded in the ground to secure the barrier in place. Still another weed or grass guard is disclosed in U.S. Pat. No. 3,515,373 to D. M. Abbe, which patent is styled, "Fence Trim Guard", and includes a pair of axially aligned, telescopically interlocking guard members designed to overlie the ground beneath a fence and between the fence posts, each guard member characterized by a longitudinal channel portion lying on the ground and preventing the growth of vegetation, and also featuring outwardly extending, perforated lateral flange portions beneath the ground to anchor the channel portion in position. A similar fence guard is illustrated and described in U.S. Pat. No. 3,713,624 to Fred T. Niemann, which guard includes a shaped barrier which is L-shaped in cross-section, and is selectively abutted against one or both sides of the fence to prevent growth of grass and weeds in that area of the fence. A pair of these fence guards can be secured together on each side of the fence to prevent the growth of vegetation on both sides of the fence. Another fence border is described in U.S. Pat. No. 3,768,780 to Tommie Cowles, et al, which patent includes a one-piece, continuous plastic or rubber device that fits between the bottom edge of the fence and the ground or grass, and having a pair of side-by-side panels which are connected by spreadable accordian pleat element to allow the device to be intially spread apart, and the lower edge of the fence force-fitted between the upper portions of the panels to secure the border in position beneath the fence. Another "Fence Trim and Vegetation Barrier" is disclosed in U.S. Pat. No. 3,806,096 to John R. Eccleston, et al, which barrier includes an elongated shell, which telescopically receives a core member on the ground beneath the fence, with the shell having a longitudinally disposed slot at one end to receive the lower portion of a selected fence post when the shell is in position on the ground, and the core being extendible from the other end of the shell into abutment with the lower portion of the next adjacent fence post.

One of the difficulties associated with prior art fence guards and vegetation shields is the requirement that most of these devices must be installed while the fence under consideration is being constructed, since most of the guards require installation over the bare fence posts prior to installation of the fencing material. Furthermore, many of these shields are rather complicated in design, and are sometimes difficult to install, and considerable trimming is frequently necessary for installation in fence lines which do not form 90 degree angles at the points of directional change.

Accordingly, it is an object of this invention to provide a new and improved, durable and attractive fence guard which is designed to reduce fence line yard maintenance, prevent the passage of small animals under the fence, and to produce an attractive fence row.

Another object of the invention is to provide a fence guard which is capable of being installed in cooperation with existing fences of substantially any design, and particularly including chain link fences, and which can be quickly and easily installed with a minimum amount of time and the requirement of very few tools.

A still further object of this invention is to provide a fence guard for eliminating grass, weeds, and the growth of other vegetation along fence lines by providing a flexible mat or guard stripping in cooperation with the bottom of the fence and the fence posts to seal an area of ground along the fence row at a selected distance transverse to the fence row.

Another object of this invention is to provide a weed and grass guard for fence rows which includes a generally elongated grass shield or guard cable of being installed in cooperation with existing fences of substantially any design, and which includes specially designed, cooperating members which compensate for directional changes in the fence, whether the directional changes are at a conventional 90 degrees or otherwise, and which also compensate for intersecting fence lines.

A still further object of the invention is to provide a fence guard for illuminating the growth of grass and weeds along fence rows and for preventing the movement of small animals under the fence, which guard includes a grass shield and specially designed gate post members cooperating with the grass shield for installation at the base of the gate posts to provide easy trimming around the gate and the fence line.

Yet another object of this invention is to provide a new and improved fence guard device for preventing the growth of weeds, grass, woody growth and other vegetation along a fence line, which guard is attractive, easily maintained and contains upward-standing edges, or flanges, and drain holes for preventing the collection of rain water or water from a sprinkler system on the guard and for dispensing a herbicide or pesticide along the fence row.

SUMMARY OF THE INVENTION

These and other objects of the invention are provided in a new and improved fence guard for preventing the growth of grass, weeds, objectionable woody growth and vegetation along fence lines, which fence guard is characterized by a generally elongated, flexible grass shield having a central slot for receiving the bottom edge of the fence, and capable of being slit and fitted with apertures at repetitive intervals to accommodate fence posts, and further including swivel plates, corner post plates, and gate plates for effecting a means of establishing the continuity of the grass shield at the points of directional change of the fence line, and at points where other fences intersect, and to provide for the installation of protected gate posts in the fence, respectively.

BRIEF DESCRIPTION OF THE DRAWING

The invention will be better understood by reference to the accompanying drawing, wherein.

DESCRIPTION OF THE PREFERRED EMBODIMENTS

Figure 1:
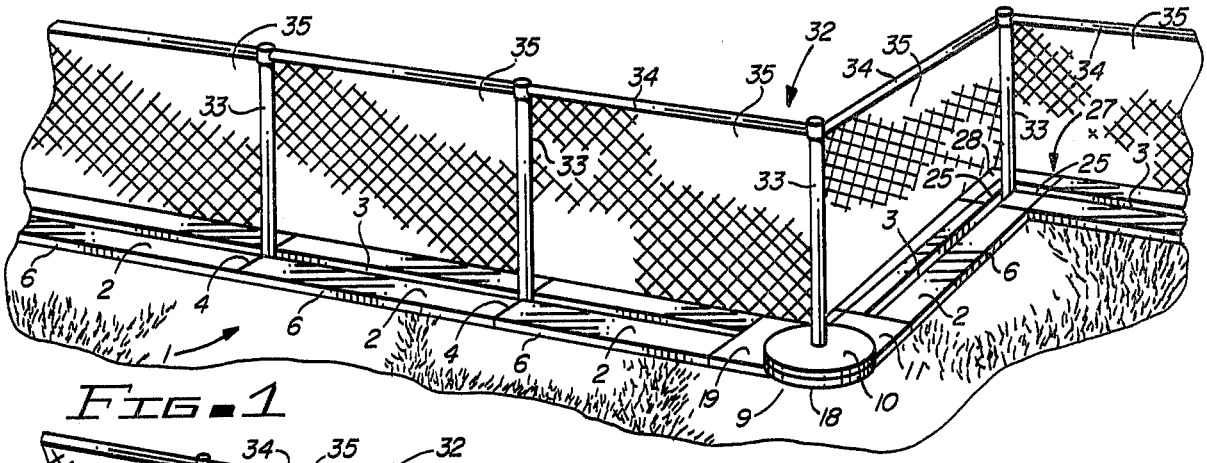
FIG. 1 is a perspective view of a segment of a fence and fence line, showing preferred embodiments of the grass shield and cooperating swivel joint and corner post plate.
Figure 3:
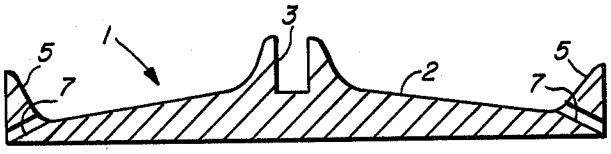
FIG. 3 is a sectional view of a preferred grass shield of the fence guard of this invention.
Figure 7:
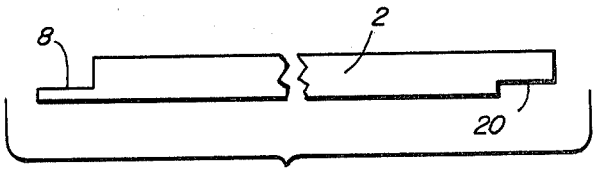
FIG. 7 is a side elevation, partially in section, of a preferred section of the grass shield of the fence guard of this invention.

Referring now to FIG. 1 of the drawing, in a preferred embodiment of the invention the fence guard of this invention is designed to be installed in cooperation with a chain link fence 32, and is generally illustrated by reference numeral 1. Fence guard 1 includes a generally elongated grass shield 2, which is formed of plastic, rubber or other flexible material capable of being easily manipulated and cut, and provided with a fence slot 3, extending down the approximate center thereof. As hereinafter described, access slits 4 are provided in one side of grass shield 2 in order to provide a means for installing the grass shield along existing fence lines by providing access for each one of fence posts 33. Referring specifically to FIGS. 1 and 3 of the drawing, in a most preferred embodiment of the invention the cross-sectional area of grass shield 2 is configured as illustrated in FIG. 3, and includes an upwardly extending shield flange 5 on each edge of the grass shield 2, with multiple drain holes 7 provided in spaced relationship along the length of grass shield 2 to allow water to drain from the shield. However, in another preferred embodiment of the invention, the grass shield 2 is configured as illustrated in FIG. 1, with a generally perpendicular shield edge 6 shaping grass shield 2. Referring now specifically to FIG. 7 of the drawing, in another preferred embodiment the opposite transverse ends of each length of grass shield 2 are provided with a grass shield tab 8, and a grass shield slot 20 for interlocking with additional lengths of the grass shield and with the swivel joints 9 and corner post plates 27, illustrated in FIG. 1, as hereinafter described.

Figure 5:
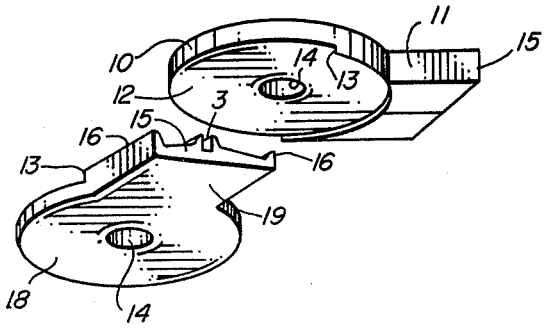
FIG. 5 is a perspective view of a preferred swivel joint in exploded illustration.

Referring to FIGS. 1 and 5, swivel joint 9 is designed to be installed on a fence post 33 which incorporates a directional change not equal to 90 degrees in the run of chain link fence 32. Referring specifically to FIG. 5 of the drawing, swivel joint 9 includes a generally circular top plate 10, provided with a top plate flange 11 extending from a portion of the periphery of top plate 10, and shaped to include a top plate seat 12 in the bottom surface of the plate, and a swivel stop 13 to limit rotation of the swivel joint 9, as hereinafter described. A plate post aperture 14 having a diameter of sufficient size to receive a fence post 33 is also provided in the center of top plate 10, as illustrated. A cooperating bottom plate 18 is designed to register with top plate seat 12 of top plate 10, and is also provided with a cooperating plate post aperture 14 and a bottom plate flange 19, which is identical to top plate flange 11. The plate flange ends 15 of both top plate flange 11 and bottom plate flange 19, are shaped to match the end portions of grass shield 2, and in a preferred embodiment of the invention plate flange ends 15 are provided with plate flange shoulders 16 for matching with the shield flange 5 provided on each edge of grass shield 2, as illustrated in FIG. 3 of the drawing. When top plate 10 and bottom plate 18 of swivel joint 9 are placed in registration on a fence post 33, as illustrated in FIG. 1, the plates are relatively rotatable on the fence post to align top plate flange 11 and bottom plate flange 19 in any direction spanning 180 degrees in order to align top plate flange 11 and bottom plate flange 19 with the cooperating lengths of grass shield 2. Accordingly, the swivel joint 9 is designed to permit grass shield 2 to be installed in any fence regardless of directional changes in the fence line with a minimum of effort and with great efficiency.

Figure 6:
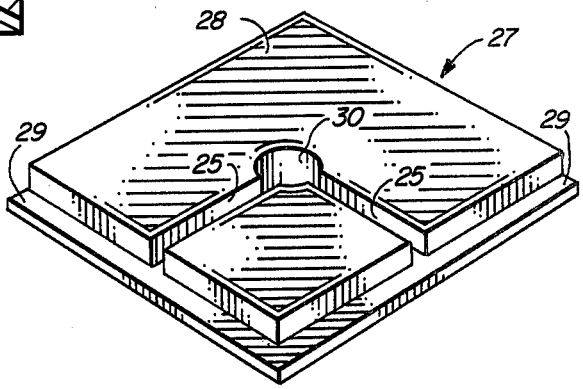
FIG. 6 is a perspective view of a preferred corner post plate for a 90 degree directional change in the fence.

Referring now to FIGS. 1 and 6 of the drawing, 90 degree directional changes in the fence and the intersection of several fence lines at a common point are accommodated by means of the corner post plate 27, which is generally square in configuration, and in a preferred embodiment, includes a projecting corner post tab 29, extending from the bottom of the corner post foot 28, as illustrated. Under circumstances where a 90 degree turn in the fence line is apparent, pair of fence slots 25 extend from adjacent edges of corner post foot 28 to a corner post aperture 30 near the center of corner post foot 28, and extend through the foot to accommodate the bottom of the fence line at the corner post position, as illustrated in FIG. 1. The corner post tab 29 is designed to cooperate with the grass shield slot 20, provided in grass shield 2, as illustrated in FIG. 7 of the drawing. Accordingly, corner post plate 27 enables grass shield 2 to be installed at a 90 degree angle in the fence line with minimum effort and great efficiency, as hereinafter described. It will be appreciated from a consideration of FIG. 6, that under circumstances where it is desired to join three or four fence lines, corner post plate 27 can be provided with additional fence slots 25 to accommodate the respective fences.

Figure 2:
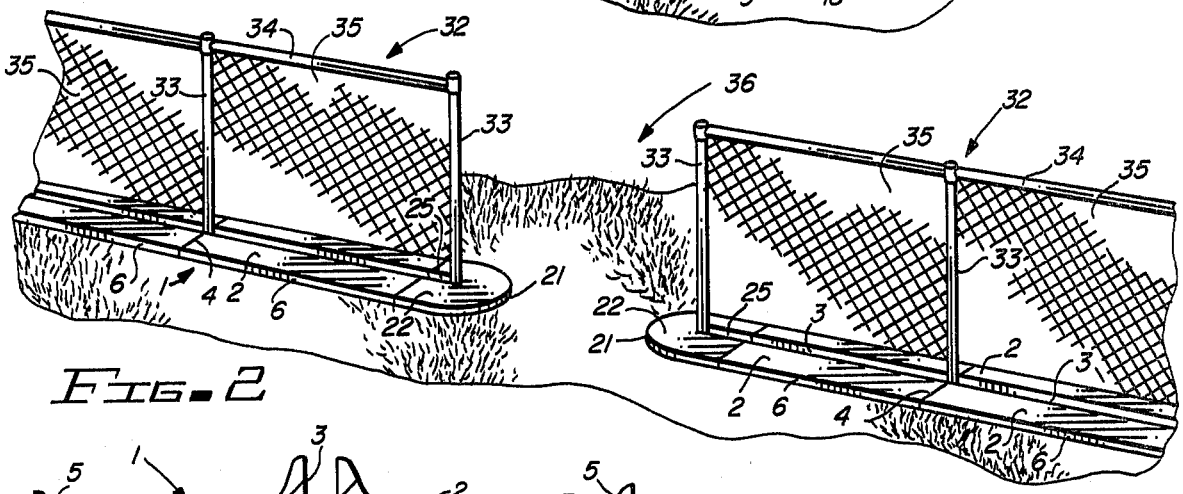
FIG. 2 is another section of the fence and fence line, more particularly illustrating the grass shield and cooperating gate plates.
Figure 4:
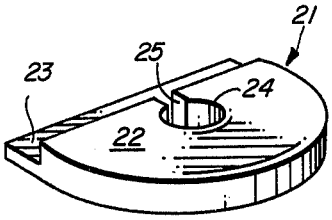
FIG. 4 is a perspective view of a preferred gate plate.

Referring now to FIGS. 2 and 4 of the drawing, in another preferred embodiment of the invention a pair of gate plates 21 is provided on each cooperating gate post 33, to enable the hinging of a gate [not illustrated] in gate space 36 of chain link fence 32. The generally rounded gate plates 21 are, in a preferred embodiment, provided with a gate plate tab 23, extending opposite the rounded end of gate plate foot 22, and a fence slot 25 extends from a centrally located foot post aperture 24, through gate plate foot 22, toward gate plate tab 23. As in the case of corner post plate 27, in a preferred embodiment of the invention, gate plate tab 23 is designed to register with the grass shield slot 20 of a length of grass shield 2, in order to more effectively seal the joint between gate plates 21 and the corresponding lengths of grass shield 2. As further illustrated in FIGS. 2 and 4, the length of gate plate foot 22 is optional, depending upon the width of gate space 36, the gate plates 21 illustrated in FIG. 2 being somewhat longer than the gate plate illustrated in FIG. 4, for purposes of illustration in order to highlight this option.

In a most preferred embodiment of the invention the fence guard 1 is installed in cooperation with an existing chain link fence 32, having spaced fence posts 33 and a post spacer 34, mounted on the top thereof in conventional fashion. Chain link 35 or similar fencing material is installed between the fence posts 33, and typically extends from immediately beneath post spacer 34 to ground level. The fence guard of this invention is installed by first extending the lengths of grass shield 2 end to end along the expanse of the fence 32, and subsequently marking the intersection of each of the fence posts 33 with a shield edge 6 of the grass shield 2. When grass shield 2 is marked in this fashion for each length of chain link fence 32, an access slit 4 is cut in one side of grass shield 2 transversely from the shield edge 6 to the center of fence slot 3, and a hole slightly larger than the diameter of fence post 33 is cut in grass shield 2 in the bottom of fence slot 3 adjacent access slit 4, for each one of fence posts 33. When these holes have been cut, each respective length of grass shield 2 is fitted to the fence posts 33 of chain link fence 32, with the bottom of chain link 35 in registration with fence slot 3 of grass shield 2, as illustrated in FIGS. 1 and 2. In another preferred embodiment of the invention the respective lengths of grass shield 2 are each provided with a shield flange 5, drain holes 7, a grass shield tab 8 and a cooperating grass shield slot 20, as illustrated in FIG. 7, for interlocking cooperation between the respective lengths of grass shield 2 and the top plate flange 11 and bottom plate flange 19 of swivel joint 9, and with corner post plate 27. It will be appreciated that the drain holes 7 are useful not only for draining water from grass shield 2, but also for dispensing liquid or a water-soluble granulated herbicide or pesticide, for additional weed or pest control along the fence line. However, in another preferred embodiment of the invention the respective lengths of grass shield 2 are not provided with grass shield tabs 8 and grass shield slots 29 and are simply butt-fitted, and a strip of sealing tape is provided on the bottom and top of the shield ends to cover the joint between these strips. Tape may also be provided on access slits 4 to prevent grass or other vegetation from growing through the slit as deemed necessary. When each respective length of grass shield 2 is in position on fence posts 33 as described above, a corner post plate 27 is provided for each of the corner posts in chain link fence 32 where the fence describes a 90 degree change in direction or where other fence lines join, and an access slit 4 is provided in each of the fence slots 25 to provide access to the fence posts 33, as illustrated in FIG. 1. Corner post plate 27 is then fitted to the corner one of fence posts 33, and the bottom edge of chain link 35 is placed in registration with fence slots 25 of corner post plate 27. As in the case of grass shield 2, in a preferred embodiment of the invention the access slits 4 are taped to prevent vegetation from growing through the slits.

As heretofore described, in a most preferred embodiment of the invention additional fence slots 25 can be provided in corner post foot 28 of corner post plate 27, under circumstances where it is desired to tie additional fence lines together. Accordingly, where four fences meet at a common fence post 33, for example, two additional fence slots 25 are provided in corner post foot 28 to accommodate the additional fences.

It will also be appreciated that the plate post aperture 14 locations in top plate 10 and bottom plate 18 of swivel joint 9, and corner post aperture 30 of corner post foot 28, as well as foot post aperture 24, of gate plates 21, may be pre-marked to indicate the appropriate hole size to be drilled for any specific size of fence posts 33.

Similarly, referring again to FIGS. 2 and 4 of the drawing, each of the gate plates 21 are positioned adjacent a gate post 33, as illustrated in FIG. 2, and a longitudinal access slit 4 is provided in fence slots 25 to permit the gate plates to be fitted tightly to each of the gate posts 33, as illustrated in FIG. 2. The bottom edge of chain link 35 is then positioned in registration with fence slots 25.

In another most preferred embodiment of the invention the grass shield of this invention is manufactured of heavy duty, heat and light-resistant nylon or plastic material which is relatively flexible, and which may typically be provided in sections or rolls about ten-feet in length. The width of grass shield 2 may vary according to the particular installation desired, but in a preferred embodiment, is about ten inches, and the height of the shield is about two inches.

Having described the invention with the particularity set forth above, what is claimed is:

1. A fence guard for retarding the growth of vegetation along a fence, comprising an elongated grass shield having a longitudinal slot along the center longitudinal axis thereof and provided with apertures in spaced relationship in said slot, said apertures corresponding to and in registration with the fence posts in said fence, said grass shield further comprising access slits provided in transverse relationship in said grass shield adjacent said apertures and communicating with said apertures for installation of said grass shield beneath said fence.

2. The fence guard of claim 1 further comprising a swivel joint characterized by a top plate having a top plate flange extending from said top plate for engagement with one end of a first length of said grass shield, and a bottom plate having a bottom plate flange extending from said bottom plate for engagement with one end of a second length of said grass shield, said top plate and said bottom plate further provided with registering plate post apertures for receiving a fence post of said fence, and relatively rotatable on said fence post and with respect to each other to join said first length and said second length of said grass shield at a point where said fence changes direction.

3. The fence guard of claim 1 further comprising a corner post plate and fence slots provided in said corner post plate, said fence slots extending in perpendicular relationship from adjacent sides of said corner post plate to a point of intersection, and a corner post aperture in said corner post plate at said point of intersection of said fence slots for receiving a corner fence post of said fence and joining separate lengths of said grass shield disposed in intersecting relationship along said fence at a point where said fence changes direction at an angle of about 90 degrees.

4. The fence guard of claim 1 further comprising:

(a) a swivel joint characterized by a top plate having a top plate flange extending from said top plate for engagement with one end of a first length of said grass shield, and a bottom plate having a bottom plate flange extending from said bottom plate for engagement with one end of a second length of said grass shield, said top plate and said bottom plate further provided with registering plate post apertures for receiving a fence post of said fence, and relatively rotatable on said fence post and with respect to each other to join said first length and said second length of said grass shield at a point where said fence changes direction at an angle not equal to 90 degrees; and (b) a corner post plate and fence slots provided in said corner post plate, said fence slots extending in perpendicular relationship from adjacent sides of said corner post plate to a point of intersection, and a corner post aperture in said corner post plate at said point of intersection of said fence slots for receiving a corner fence post of said fence and joining separate lengths of said grass shield disposed in intersecting relationship along said fence at a point where said fence changes direction at an angle of about 90 degrees.

5. The fence guard of claim 1 further comprising a pair of gate plates having curved faces in spaced, oppositely disposed relationship on each side of a gate opening in said fence, and a fence slot extending from an end of each of said gate plates opposite said curved faces to a point near said curved faces, and a gate plate aperture in each of said gate plates at said point near said curved faces and communicating with said fence slot, said gate plates each mounted on a gate post in said fence.

6. The fence guard of claim 1 further comprising:

(a) a swivel joint characterized by a top plate having a top plate flange extending from said top plate for engagement with one end of a first length of said grass shield, and a bottom plate having a bottom plate flange extending from said bottom plate for engagement with one end of a second length of said grass shield, said top plate and said bottom plate further provided with registering plate post apertures for receiving a fence post of said fence, and relatively rotatable on said fence post and with respect to each other to join said first length and said second length of said grass shield at a point where said fence changes direction at an angle not equal to 90 degrees;

(b) a corner post plate and fence slots provided in said corner post plate, said fence slots extending in perpendicular relationship from adjacent sides of said corner post plate to a point of intersection, and a corner post aperture in said corner post plate at said point of intersection of said fence slots for receiving a corner fence post of said fence and joining separate lengths of said grass shield disposed in intersecting relationship along said fence at a point where said fence changes direction at an angle of about 90 degrees; and (c) a pair of gate plates having curved faces in spaced, oppositely disposed relationship on each side of a gate opening in said fence, and a fence slot extending from an end of each of said gate plates opposite said curved faces to a point near said curved faces, and a gate plate aperture in each of said gate plates at said point near said curved faces and communicating with said fence slot, said gate plates each mounted on a gate post in said fence.

7. The fence guard of claim 1 further comprising an upward-extending shield flange along both longitudinal edges of said grass shield.

8. The fence guard of claim 7 further comprising drain holes provided in spaced relationship in said grass shield near said shield flange.

9. The fence guard of claim 1 further comprising:

(a) a swivel joint characterized by a top plate having a top plate flange extending from said top plate for engagement with one end of a first length of said grass shield, and a bottom plate having a bottom plate flange extending from said bottom plate for engagement with one end of a second length of said grass shield, said top plate and said bottom plate further provided with registering plate post apertures for receiving a fence post of said fence, and relatively rotatable on said fence post and with respect to each other to join said first length and said second length of said grass shield at a point where said fence changes direction at an angle not equal to 90 degrees;

(b) a corner post plate and fence slots provided in said corner post plate, said fence slots extending in perpendicular relationship from adjacent sides of said corner post plate to a point of intersection, and a corner post aperture in said corner post plate at said point of intersection of said fence slots for receiving a corner fence post of said fence and joining separate lengths of said grass shield disposed in intersecting relationship along said fence at a point where said fence changes direction at an angle of about 90 degrees;

(c) a pair of gate plates having curved faces in spaced, oppositely disposed relationship on each side of a gate opening in said fence, and a fence slot extending from an end of each of said gate plates opposite said curved faces to a point near said curved faces, and a gate plate aperture in each of said gate plates at said point near said curved faces and communicating with said fence slot, said gate plates each mounted on a gate post in said fence; and (d) an upward-standing shield flange along both longitudinal edges of said grass shield.

10. The fence guard of claim 9 further comprising drain holes provided in spaced relationship in said grass shield near said shield flange.

* * * * *